United States Patent [19]

Cooper

[11] 3,970,788

[45] July 20, 1976

[54] MONAURAL AND STEREO COMPATIBLE MULTIDIRECTIONAL SOUND MATRIXING

[76] Inventor: Duane H. Cooper, 918 W. Daniel St., Champaign, Ill. 61820

[22] Filed: May 16, 1975

[21] Appl. No.: 578,078

Related U.S. Application Data

[60] Division of Ser. No. 288,873, Sept. 13, 1972, Pat. No. 3,906,156, and a continuation-in-part of Ser. No. 187,065, Oct. 6, 1971, Pat. No. 3,856,992.

[52] U.S. Cl. ..... 179/1 GQ; 179/15 BT; 179/100.4 ST

[51] Int. Cl.[2] ..... H04R 5/00

[58] Field of Search ..... 179/1 GQ, 1 G, 15 BT, 179/100.1 TD, 100.4 ST

[56] References Cited

UNITED STATES PATENTS

| | | | |
|---|---|---|---|
| 3,679,832 | 7/1972 | Halpern | 179/15 BT |
| 3,708,623 | 1/1973 | Dorren | 179/15 BT |
| 3,754,099 | 8/1973 | Takaoka | 179/15 BT |
| 3,761,628 | 9/1973 | Bauer | 179/1 GQ |
| 3,814,858 | 6/1974 | Parker | 179/15 BT |
| 3,824,342 | 7/1974 | Christensen et al. | 179/15 BT |

OTHER PUBLICATIONS

"Multichannel Stereo Matrix Systems: An Overview," by Eargle in *Journal of Audio Engr. Soc.*, July–Aug. 1971, vol. 19, No. 7.

"On the Processing of Two– and Three–Channel Program Material for Four–Channel Playback," by Eargle in *Journal of the Audio Eng. Society*, Apr. 1971, vol. 19, No. 4, pp. 262–266.

"Further Improvements in the Discrete Four–Channel Disc System CD–4," by Owaki et al., in *Journal of Audio Eng. Society*, June 1972, vol. 20, No. 5, pp. 361–369.

*Primary Examiner*—Douglas W. Olms

*Attorney, Agent, or Firm*—Fitch, Even, Tabin & Luedeka

[57] ABSTRACT

Multidirectional source signals which are encoded in two monaural and stereo-compatible transmission channels with predetermined amplitude and phase relations indicative of source directions and adapted to be decoded for formation of more than two loudspeaker presentation signals having source signals corresponding to every source direction appearing in a plurality of such presentation signals, but in differing relative amplitude, are decoded with at least one auxiliary channel. The auxiliary channels have the source signals encoded therein with amplitude and phase relations differently indicative of source directions, and the decode of the two mono and stereo compatible channels is combined with the decode of the auxiliary channels to produce presentation signals with sharpened directionality. Also disclosed are limited-frequency auxiliary channels.

7 Claims, 13 Drawing Figures

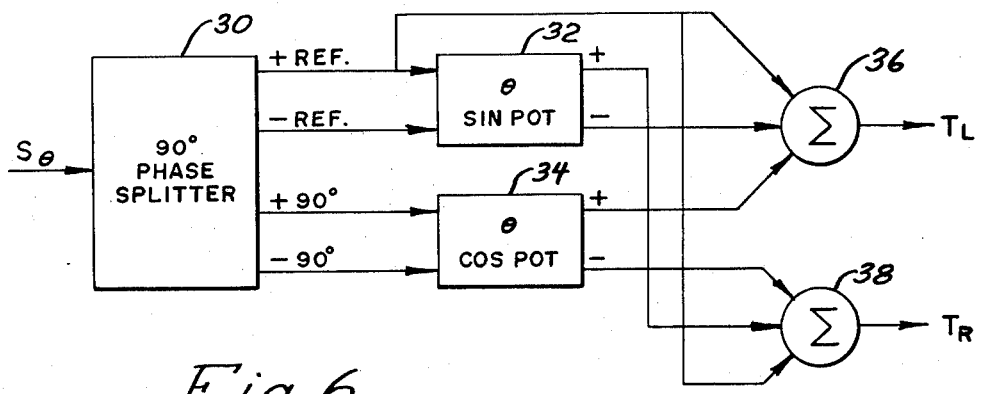
Fig. 6
Fig. 7
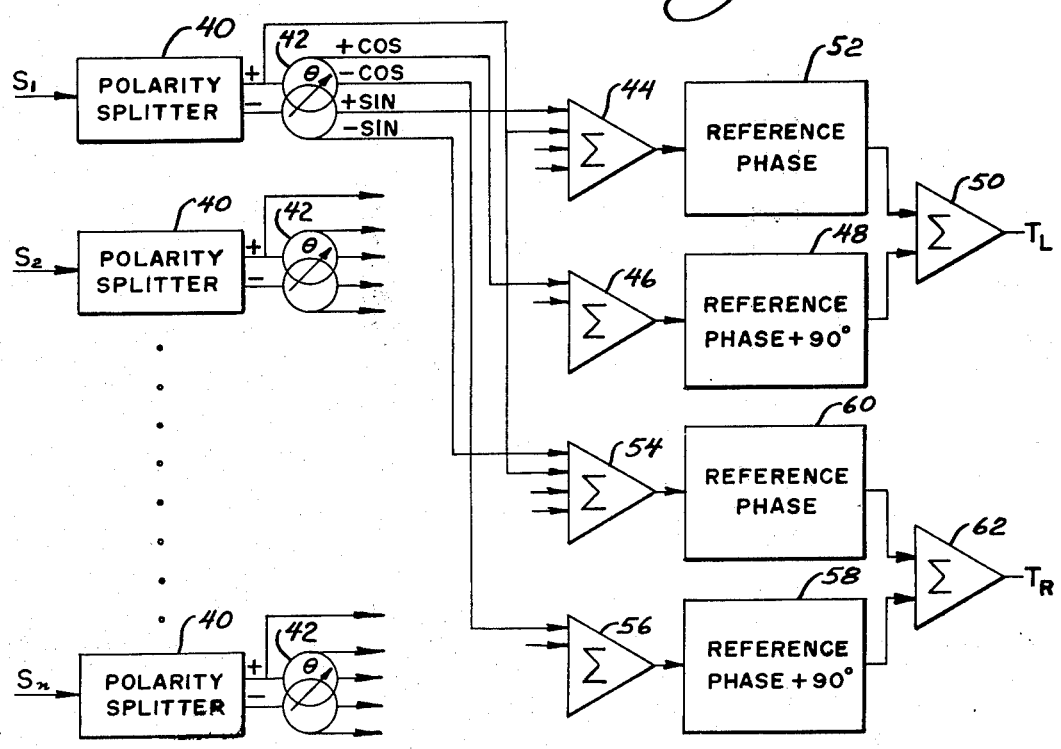

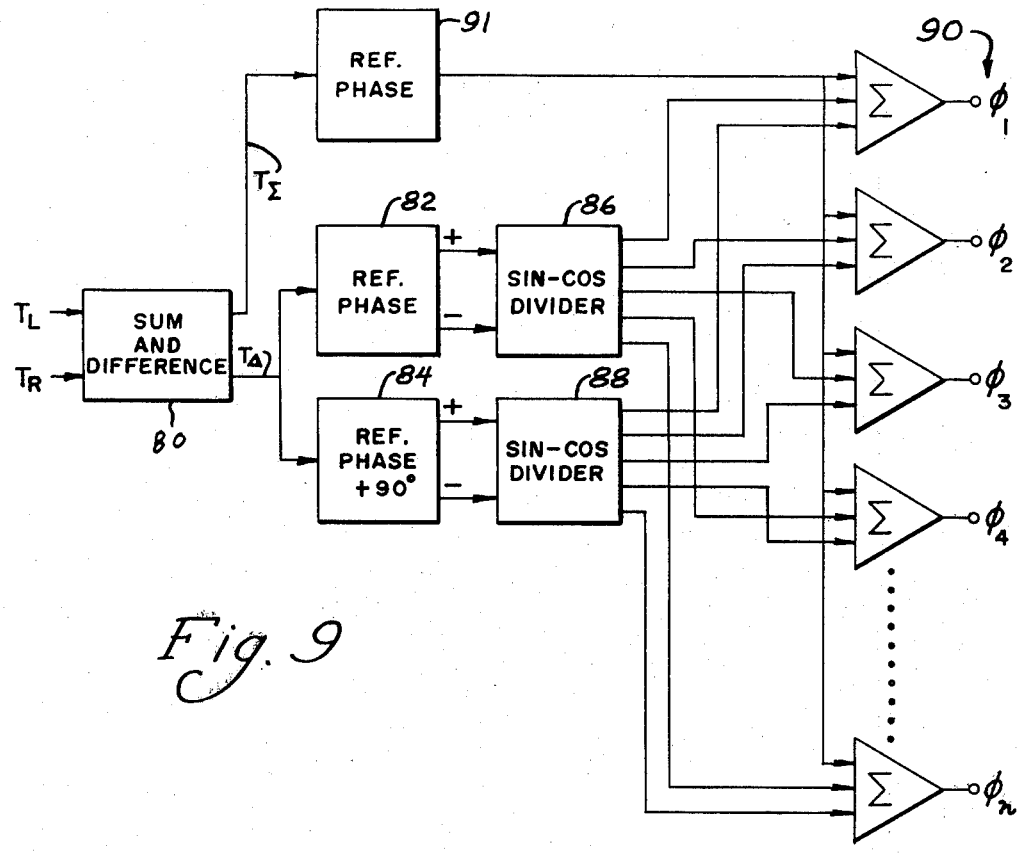
Fig. 9
Fig. 10
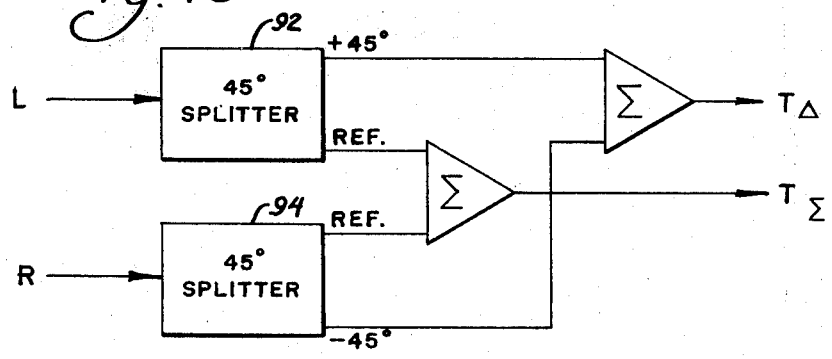

Fig. 12

ENCODE $$\begin{bmatrix} T_\Sigma \\ T_\Delta \end{bmatrix} = \begin{bmatrix} 1.0\angle 0^\circ & 1.0\angle 0^\circ & 1.0\angle 0^\circ & 1.0\angle 0^\circ \\ 1.0\angle +135^\circ & 1.0\angle -135^\circ & 1.0\angle -45^\circ & 1.0\angle +45^\circ \end{bmatrix} \cdot \begin{bmatrix} S_{LB} \\ S_{LF} \\ S_{RF} \\ S_{RB} \end{bmatrix}$$

$$\begin{bmatrix} T_T \\ T_Q \end{bmatrix} = \begin{bmatrix} 1.0\angle -135^\circ & 1.0\angle +135^\circ & 1.0\angle +45^\circ & 1.0\angle -45^\circ \\ 1.0\angle -90^\circ & 1.0\angle +90^\circ & 1.0\angle -90^\circ & 1.0\angle +90^\circ \end{bmatrix} \cdot \begin{bmatrix} S_{LB} \\ S_{LF} \\ S_{RF} \\ S_{RB} \end{bmatrix}$$

DECODE $$\begin{bmatrix} P_{LB} \\ P_{LF} \\ P_{RF} \\ P_{RB} \end{bmatrix} = \begin{bmatrix} 1.0\angle 0^\circ & 1.0\angle -135^\circ \\ 1.0\angle 0^\circ & 1.0\angle +135^\circ \\ 1.0\angle 0^\circ & 1.0\angle +45^\circ \\ 1.0\angle 0^\circ & 1.0\angle -45^\circ \end{bmatrix} \cdot \begin{bmatrix} T_\Sigma \\ T_\Delta \end{bmatrix} + \begin{bmatrix} 1.0\angle +135^\circ & 1.0\angle +90^\circ \\ 1.0\angle -135^\circ & 1.0\angle -90^\circ \\ 1.0\angle -45^\circ & 1.0\angle +90^\circ \\ 1.0\angle +45^\circ & 1.0\angle -90^\circ \end{bmatrix} \cdot \begin{bmatrix} T_T \\ T_Q \end{bmatrix}$$

OVERALL $$\begin{bmatrix} P_{LB} \\ P_{LF} \\ P_{RF} \\ P_{RB} \end{bmatrix} = \left\{ \begin{bmatrix} 2.0\angle 0^\circ & 1.4\angle +45^\circ & 0.0 \cdots & 1.4\angle -45^\circ \\ 1.4\angle -45^\circ & 2.0\angle 0^\circ & 1.4\angle +45^\circ & 0.0 \cdots \\ 0.0 \cdots & 1.4\angle -45^\circ & 2.0\angle 0^\circ & 1.4\angle +45^\circ \\ 1.4\angle +45^\circ & 0.0 \cdots & 1.4\angle -45^\circ & 2.0\angle 0^\circ \end{bmatrix} + \begin{bmatrix} 2.0\angle 0^\circ & 1.4\angle -135^\circ & 0.0 \cdots & 1.4\angle +135^\circ \\ 1.4\angle +135^\circ & 2.0\angle 0^\circ & 1.4\angle -135^\circ & 0.0 \cdots \\ 0.0 \cdots & 1.4\angle +135^\circ & 2.0\angle 0^\circ & 1.4\angle -135^\circ \\ 1.4\angle -135^\circ & 0.0 \cdots & 1.4\angle +135^\circ & 2.0\angle 0^\circ \end{bmatrix} \right\} \cdot \begin{bmatrix} S_{LB} \\ S_{LF} \\ S_{RF} \\ S_{RB} \end{bmatrix}$$

Fig. 13

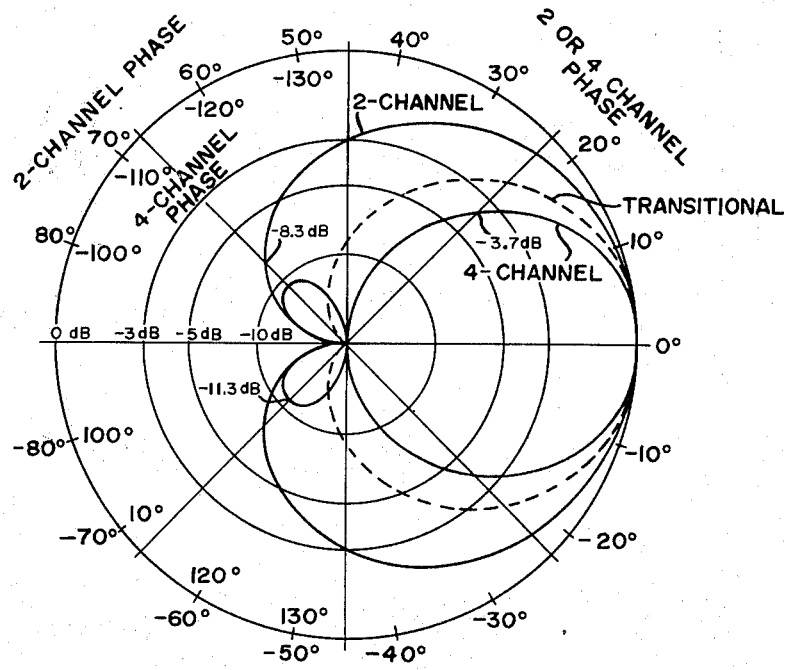

MONAURAL AND STEREO COMPATIBLE MULTIDIRECTIONAL SOUND MATRIXING

This is a division of application Ser. No. 288,873, filed Sept. 13, 1972, now U.S. Pat. No. 3,906,156 and is a continuation-in-part of application Ser. No. 187,065, filed Oct. 6, 1971, now U.S. Pat. No. 3,856,992.

This invention relates to reproduction of multidirectional audio program material with greater directionality and ambience than those of conventional stereo reproduction, and to the recording and/or transmission of program material for such reproduction. More particularly, the invention relates to the coding or mixing of directional sound information into a number of recording or transmission channels smaller (at least normally) than the number of sound sources to be reproduced and decoding or signal treatment and distribution of the content of these channels to reproducers differing in number or location from the sound-source locations for reproduction simulating presence at the original performance in psychoacoustic impression.

Although the invention in its broader aspects is not limited to any specific number of sound sources (typified by microphones) or reproducers (typically loudspeakers), it will most readily be understood by initial reference to the type of reproduction which has become popularly known as "quadrasonic" or "quad", an extension of two-speaker stereo techniques to the reproduction of multidirectional program material with four loudspeakers to increase the sensory illusion of presence or ambience. The term quadrasonic originated to describe systems wherein exciting or presentation signals for individual reproducers are maintained in separate and discrete form as separate signal channels, as in four-speaker reproduction from four-track tape. However the term is now commonly used, and is used herein, to include what have sometimes been called "pseudo" four-channel systems, wherein four (or more) original directional sound-source channels are mixed or combined by encoding into two signal channels, and thereafter decoded to produce four presentation signals for feeding the speakers. It is impossible, in such a manner, to produce exact or pure correspondence between the excitation of each loudspeaker and the output of a correspondingly-located microphone. But it has been known for some time that results which are psychoacoustically reasonably simulative of transmission through four discrete channels can be obtained by such "4 to 2 to 4" signal processing or matrixing. (There also exist systems wherein no directional information whatever is added to conventional stereo signals, the latter being processes, with preselected delay, etc., to feed one or more back speakers in addition to the conventional front speakers, thus producing wholly synthetic psychoacoustic impressions of added directional effects, but the present invention is not directly concerned with these.)

A present requirement for widespread adoption of any quadrasonic system is that of compatibility with continued use of existing reproducing equipment, monaural and stereo. Stated otherwise, it is generally recognized that recordings made for quadrasonic reproduction are desirably capable of satisfactory reproduction by monoaural record-players and conventional stereo record-players, and quadrasonic FM transmissions (whether live or from recordings) must similarly be reproduced as monaural or stereo material by existing receivers.

A number of encoding and decoding systems compatible with mono and stereo equipment have been proposed, and some have been the subject of experimentation and preliminary forms of commercialization. One typical publication on the subject is the paper of Peter Scheiber in *Journal of the Audio Engineering Society*, Volume 19, page 267 (April, 1971) describing such a system. A number of other systems have been devised by or for various producers of phonograph records, signal-processing equipment, etc. All of these are found on analysis to have various drawbacks or objections. The relative importance of the weaknesses or inadequacies of each of such known systems is differently estimated by their proponents, but none of the 4-2-4 systems heretofore proposed has been sufficiently close to the performance of discrete four-channel reproduction to result in adoption as a standard system of encoding and decoding for use in stereo disc recordings and stereo FM broadcasting equipment.

Another type of approach to the problem which has recently been suggested involves the use of audio-modulated supersonic carrier techniques whereby two additional transmission channels are added to conventional stereo signals, i.e., 4-4-4 systems of varying degrees of compatibility with monaural and stereo reproduction.

The present invention flows from study of the weaknesses or inadequacies of the systems heretofore proposed, and lies in the devising of novel methods and apparatus of encoding and decoding multiple-source and multiple-reproducer signals which not only involve, in a 4-2-4 system, a minimum of sacrifice of the performance obtained with the respective reproducer signals maintained in separate channels throughout, but additionally provide much greater flexibility than previous such systems afford, as well as providing considerable further advantage in supplemental extension to two further transmission channels where these are available, as later discussed.

Full details of the fairly numerous two-channel matrixing systems recently proposed or introduced by the record and equipment manufacturers mentioned above are not in all cases publicly available, but the general nature of their imperfections in performance are observable. In any 4-2-4 systems, including the present system, a sound which emanates from a single point (notably a point located to activate only a single microphone) is ultimately reproduced not from a single loudspeaker, but from a plurality of differently located loudspeakers, excited from the same original source but with an excitation amplitude relation such that from a psychoacoustic standpoint reproduction from a single direction is satisfactorily simulated. However, in the otherwise-best of the 4-2-4 systems heretofore devised, the satisfactoriness of this illusion of directionality is not uniform for all directions. The nature of the anomalies or directional ambiguities in signals intended to appear to the listener to come from particular directions in the prior art systems is not wholly identical in each case, nor are the sound directions from which the prior art matrixing systems produce anomalous results the same. Typical examples, however, are opposite-phase reproduction from rear speakers and similar anomalies which result in more faithful reproduction of front-oriented sounds than rear-oriented sounds. In some cases, the anomalies are more or less negligible in psychoacoustic impression with most program materials, but become highly noticeable with materials with "sound effects" specifically designed for quadrasonic reproduction, wherein rear sounds are not merely supplementary.

It is a principal object of the present invention to provide a two-channel transmission system for quadrasonic or similar reproducing systems which avoids such flaws or imperfections of previous systems, and thus more closely approaches the psychoacoustic simulation of systems employing completely separate and discrete transmission channels for the excitation of each reproducer. In addition to achieving this principal object, however, the invention provides methods and apparatus whereby it is unnecessary to maintain, for satisfactory performance, a single predetermined set of positions of the loudspeakers with respect to the listener to produce satisfactory reproduction. The systems of the prior art (including transmission in four discrete channels) require a single specific orientation of the loudspeakers with respect to the listener. In most cases, a pair of back speakers is added to the front speakers of a conventional stereo system to form a "2 plus 2" array. In at least one case, however, the speakers are to be arranged in the form of a diamond or "1-2-1", i.e., at opposite sides of the listener and at the center front and back. With all these prior art systems, the required speaker orientation is specified in connection with the directions represented by the four discrete transmission channels or with the coding used in the two-channel transmission or recording, and no manner is provided, so far as is known, for using different speaker orientations, or a different number of speakers, while retaining satisfactory reproduction.

Unlike the encoding and decoding systems of the prior art, the encoding and decoding of the present invention is capable of producing the same reproduction characteristics for all directions, and may be described as "directionally symmetrical". The meaning of this term as herein used may be most easily understood by considering the simple example of the reproduction of a sound whose source is successively moved to actuate each of four orthogonally located microphones in succession. In a system with directional symmetry, a listener who turns through corresponding successive 90° angles hears the sound source in wholly identical fashion as it is correspondingly moved through the four positions. This property is inherent in a quadrasonic system with a separate signal channel for transmission of each microphone output but is not obtainable with prior art 4-2-4 matrix systems. As indicated above, this is particularly important in permitting use of new types of program material wherein there is to be conveyed a realistic impression of an independent sound source (a voice or chorus for example) at a localized location rearward of the listener.

In addition to eliminating this limitation on utility, the directional symmetry of the matrixing, as a further aspect of the invention, permits simple signal-conversion whereby the geometry of a loudspeaker system may be "rotated" with respect to the loudspeaker geometry assumed in the signal-production to permit wholly satisfactory reproduction of (for example) a recording or FM transmission designed for 2-plus-2 speaker orientation by a reproducing system with speakers arranged in the 1-2-1 form of a diamond, or vice versa. Indeed, the invention provides methods and apparatus whereby the number and arrangement of speakers to be used in reproduction is essentially unidentified in the signal transmission, which is "universal" and may be decoded into presentation signals for feeding any desired number and orientation of speakers. The two encoded transmission channels may be decoded to produce, for example, six speaker-feed signals, with the speakers disposed in the form of a hexagon, the resultant listener sensation approximating that obtained with discrete six-channel transmission.

Although such advantages are obtained by mere substitution of the two-channel matrix of the invention for the various 4-2-4 systems heretofore known, the invention has even more unique properties in its extension to transmission in larger numbers of channels, such as four.

The two-channel matrixing system hereinafter to be described produces loudspeaker presentation signals which may be shown to contain the maximum possible azimuthal localization information which can be conveyed with a two-transmission-channel matrix which is directionally symmetrical. Such a system cannot be made "discrete", i.e., a sound portrayed as emanating from the azimuthal direction coinciding with that of a speaker is always necessarily also presented by the two adjacent speakers, although in such reduced amplitude and in such phase relation that the psychoacoustic sound localization is satisfactory. This pattern of presentation can be sharpened, i.e., the fractional ratio of the undesired-direction presentations to the center or desired-direction presentation can be reduced, only by addition of one or more further transmission channels adding to the directional acutance. Where two further transmission channels are added to the basic system, with a quadrasonic speaker array, wholly discrete reproduction may be obtained, i.e., a sound which could be reproduced in only a single speaker by using an ordinary four-track tape recording can also be reproduced by the present system from a single speaker, with the others silent. For any program materials (rarely encountered) which consist primarily of sounds to be reproduced as emanating directly from the four cardinal loudspeaker positions, the performance is accordingly psychoacoustically indistinguishable from that produced in a four-channel system wherein the speaker signals are maintained wholly separated throughout. However, unlike the latter type of four-channel discrete system, the discrete matrix of the present invention is readily made wholly compatible with any type of conventional monaural or stereophonic reproduction. Moreover, the four-channel system of the invention is found to produce substantially better psychoacoustic localization of "phantom" azimuthal locations, i.e., directional sound images which do not correspond to any actual speaker location, than conventional four-track presentation. The discrete or sole operation of a speaker located directly at the "source" azimuth is obtained in the present four-channel matrixing system by nulls which appear at 90°, 180° and 270°, in the overall pattern of reproduction of a signal to be sensed as being at any given speaker location. In addition to the already-mentioned advantages over conventional discrete transmission in the same number of channels, the present system offers the further advantage that the two supplemental channels may be transmitted with a very restricted frequency range without impairment of the improvement in directional localization which they give. Thus bandwidth requirements are substantially reduced for transmission in media which would otherwise require transmission of the entire audio range in each transmission channel.

Both the basic two-channel matrixing system of the invention and the above described addition thereto of further channels for increase of the acutance of directional reproduction will best be understood by reference to the explanatory illustrations and embodiments of the attached drawing, in which:

FIG. 6 is a block diagram of an exemplary single-signal encoder embodying the invention;

FIG. 7 is a block diagram of a "universal" encoder for numerous sound signals embodying the invention;

FIG. 9 is a block diagram of another form of decoder of the invention;

FIG. 10 is a block diagram of an adapter circuit for employing the decoder of FIG. 9 with conventional stereo signals;

Figure 11:
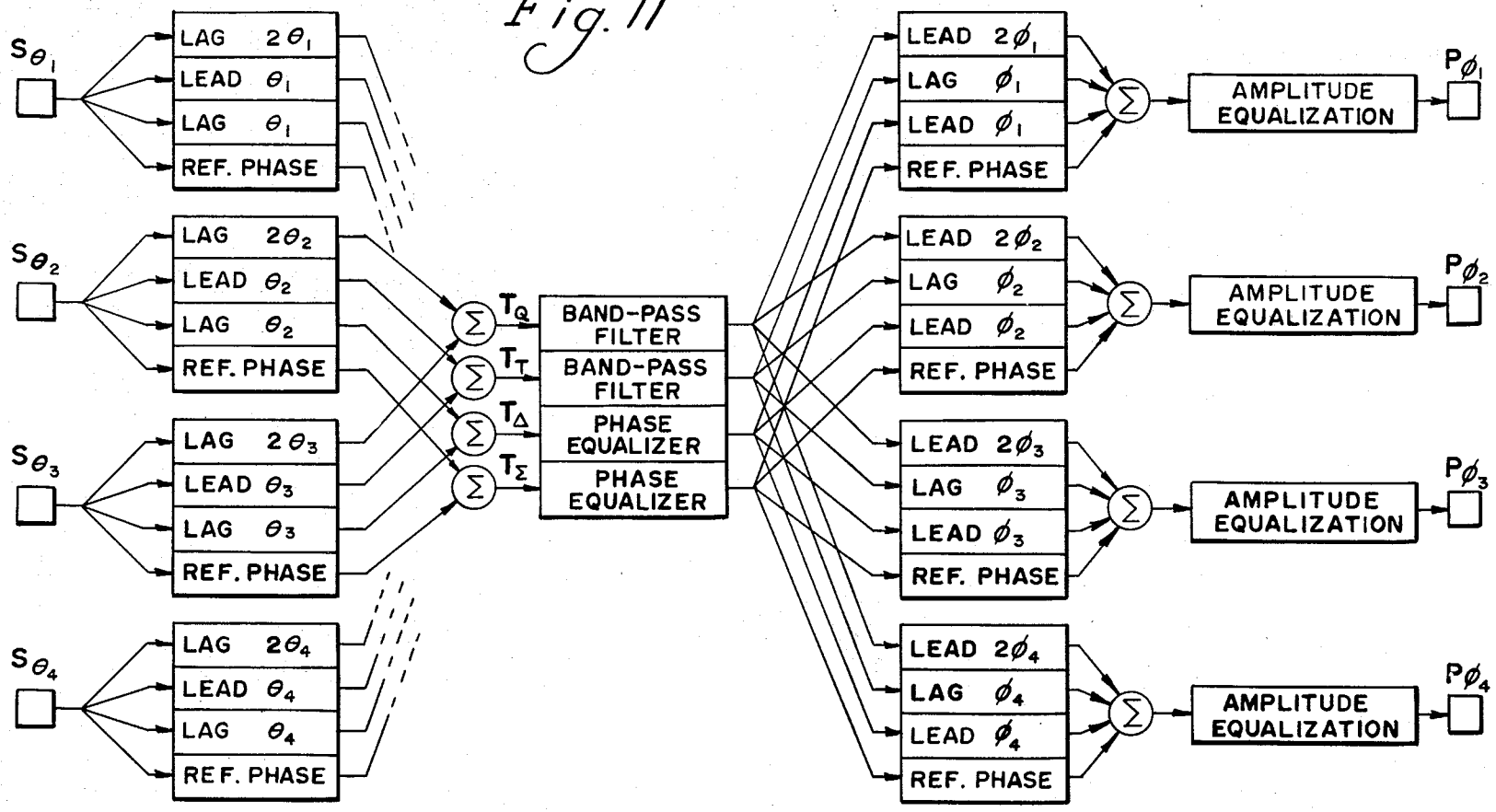
FIG. 11 is a block diagram of an overall 4-4-4 mixing and transmission system according to the invention.

FIG. 12 is a matrix-equation representation of the encoding, decoding and presentation of the system of FIG. 11; and FIG. 13 is a polar diagram showing the amplitude and phase of reproduction of a directional sound signal as a function of the azimuthal angle between each direction of reproduction and the direction whence it is sensed to originate by a listener, for the basic two-channel transmission system and for the four-channel transmission system, with a dotted showing of characteristics later described.

Figure 1:
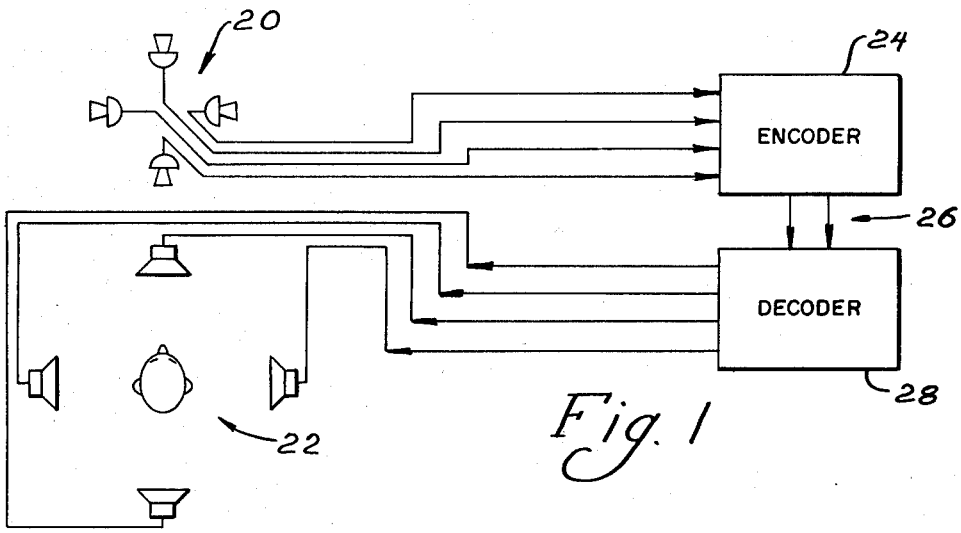
FIG. 1 is a schematic illustration of one type of quadrasonic sound reproduction system.
Figure 2:
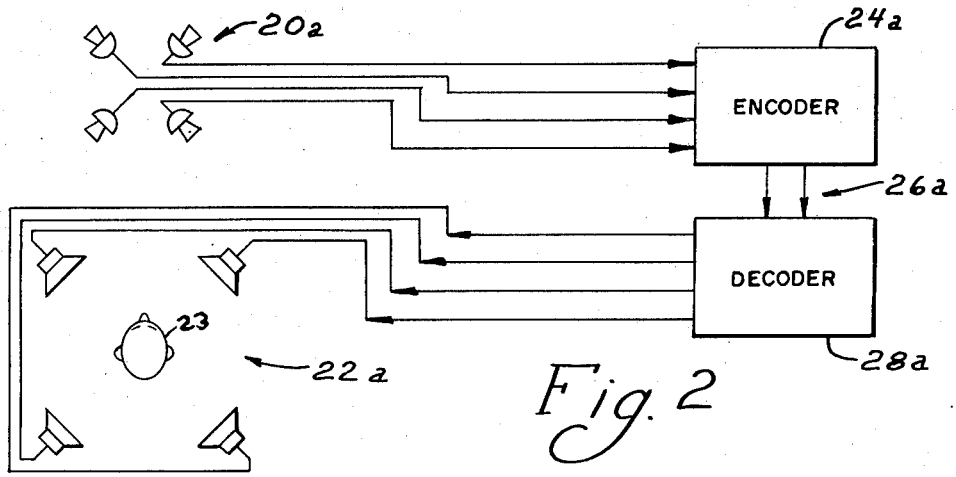
FIG. 2 is a similar illustration of a variant type of quadrasonic sound reproduction system.
Figure 3:
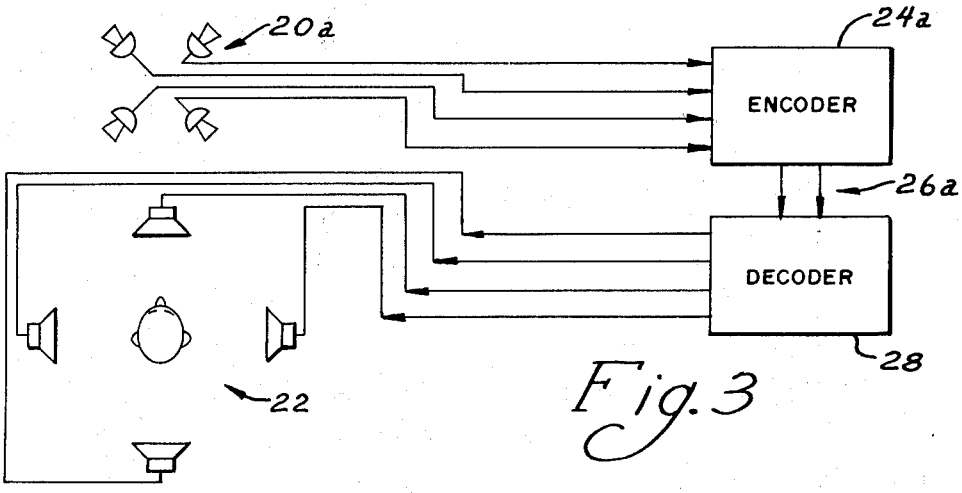
FIG. 3 is a similar illustration, but differing from the previous Figures in the employment of non-corresponding source-signal and reproduction locations.

In FIGS. 1 through 3 there are shown basic forms of quadrasonic sound systems which may advantageously employ the invention. FIGS. 1 and 2 show systems which are, except for the matrices for encoding and decoding transmission signals, the same as certain systems of the prior art. These exemplary systems are illustrated and described to facilitate understanding of the advantages and broad utility of the encoding and decoding (alternatively called matrixing and re-matrixing) of the present invention to be later described.

The systems of FIGS. 1 and 2 are alternate forms of quadrasonic systems heretofore employed with various matrixing systems. In each case, there is shown an array or pattern of orthogonal microphones 20 or **20*a* at a program location with a corresponding orthogonal array or pattern of loudspeakers 22 or 22*a* in the listening space surrounding a listener 23. In the system of FIG. 2, the microphones 20*a* are arranged to receive sounds from, and the speakers 22*a* are arranged to reproduce sounds from, locations at the left front (LF), right front (RF), right back (RB), and left back (LB) portions of the program and listening spaces, respectively, while in FIG. 1 the locations 20 and 22** are at front (F), right (R), back (B) and left (L).

Encoders or matrixers 24 and **24*a* produce two transmission signals at 26 or 26*a* which are then decoded or rematrixed at 28 or 28*a*** to produce presentation signals for driving the speakers at the corresponding locations.

Although the representations of speaker locations at LR, LF, LB and RB in FIG. 2 and at L, F, R and B in FIG. 1 are more or less truly representative of locations actually used in practice in what are called 2-plus-2 and 1-2-1 quadrasonic orientations, the corresponding showings of the microphones will be recognized by those skilled in the art as considerably simplified showings of actual microphone placements normally used for quadrasonic reproduction, particularly in making recordings. Although simple systems such as illustrated, i.e., four directional (cardioid-pattern) microphones, can be and are sometimes used, for example at a normal listener location in a concert hall, it is more common to employ more complex microphone arrangements and to blend the outputs of various microphones for effects judged most pleasing; indeed, as in the case of ordinary stereo recording-studio and broadcast-studio techniques, the multidirectional signals may be synthesized or assembled from a much larger number of sound tracks of individual instruments or groups of instruments. It will accordingly be understood, both in connection with the drawing and in connection with further discussion herein, that an audio signal representative of the sound from a particular direction may be wholly synthetic as regards directional information. As later seen, the present invention additionally provides simple means for such synthesis.

As will also be understood by those skilled in the art, the illustrations of FIGS. 1 and 2 represent signal-formation and processing operations which may be carried out in a manner producing instantaneous reproduction of live program material but more normally involve some form of storage, i.e., recording, of the signals at one or more points in the sequence. Typically, the two transmission signals are the "left" and "right" groove-walls of an ordinary stereo disc recording or the corresponding audio channels of a stereo broadcast; it is of course the two-channel limits presently imposed by these media which creates the greatest necessity for encoding and decoding, rather than direct transmission in discrete channels.

The matrixing or coding of the present invention is advantageously employed in even a simple fixed-position system such as that of FIG. 1 or FIG. 2 because of the directional symmetry which the invention affords. However, a further advantage of the present matrixing method and apparatus is its breadth of utility. The present matrixing is not only readily adapted to use in the systems of both FIGS. 1 and 2, but permits decoding for highly satisfactory use of loudspeaker geometries or orientations which are not in any way "matched" to the source-signal geometry or orientation. One example of such an overall system is shown in FIG. 3, where outputs of the microphone system (or synthesized directional signals representative of sound sources) **20*a* and encoder 24*a* of FIG. 2 are reproduced by the decoder 28 and loudspeakers 22** of FIG. 2. As will be seen below, the present matrixing or coding and decoding system not only gives excellent reproduction from all angles with such "rotated" geometries but permits employment of even more diverse source-signal and reproduction geometries, such as the employment of any number of loudspeakers desired by the listener.

Figure 4:
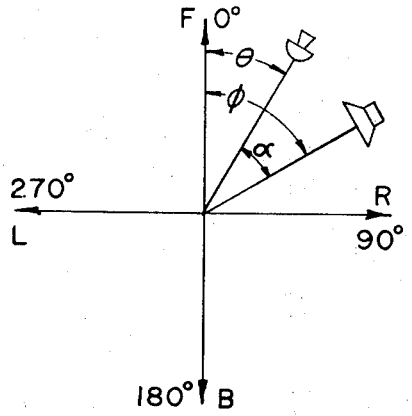
FIG. 4 is a schematic view illustrating certain angular relations employed in the invention.

FIG. 4 illustrates, for identification, certain angular relations employed in the matrixing and re-matrixing or coding and decoding of the invention. In the present invention, the magnitude and phase with which each source signal appears in each presentation signal is determined wholly and solely by the angular relation between the direction or location represented by the source signal and the direction or location of the loudspeaker to which the presentation signal is to be fed. Where the overall reproduction matrix (the product of the encoding and decoding matrices) is such that the magnitude and phase of each source signal (relative to its original magnitude and phase) in each presentation signal is everywhere a function of only this angular relation, complete directional symmetry is achieved in any system like that of FIGS. 1 to 3. The angle between any given sound source (actual or synthesized microphone placement) and loudspeaker location may be designated as $\alpha$, shown in FIG. 4. It will be seen that all values of $\alpha$ are the same in FIG. 1 and FIG. 2, and identical overall matrices for both of these geometries are accordingly produced by the invention, as later seen. However, the encoding matrices at 24 and 24*a* in the respective Figures are not numerically the same but are desirably selected in a manner preserving stereo compatibility, i.e., capability of stereo reproduction or equipment having no decoder. This is done, as hereinafter amplified, by determining the encoding matrix coefficients at 24 or 24*a* in accordance with an angle $\theta$ defining the bearing angle of each source with respect to a laterally neutral (front or back) direction and determining the matrix coefficients of the decoder 28 or 28*a* in accordance with the bearing angle $\phi$ of each loudspeaker with respect to a laterally neutral position in forming the presentation angle $\phi$ of each loudspeaker with respect to a laterally neutral position in forming the presentation signals. As shown in FIG. 4, and as presently adopted in description of the invention, the laterally neutral reference position is considered the front position and angles are measured clockwise; but references herein to left, right, and similar terminology will be understood to be used for convenience of expression rather than specific limitation, the effects of reversals, etc., being obvious.

As will be obvious, no matrixing and re-matrixing can produce an overall matrix which is "perfect" in the same sense as perfection can be obtained where there is no necessity of compressing the number of signal channels for transmission. However the requirements of a perfect overall matrix are more closely met than heretofore known by employing matrices of the present invention.

A universal encoding matrix for forming two transmission signals $T_L$ and $T_R$ from any number, n, of sources is:

$$T_L = \sum_{k=1}^{n} S_k \left(1 + e^{j(\theta_k + \frac{\pi}{2})}\right) = \sum_{k=1}^{n} S_k (1 - \sin\theta_k + j\cos\theta_k)$$

$$T_R = \sum_{k=1}^{n} S_k \left(1 - e^{j(\theta_k + \frac{\pi}{2})}\right) = \sum_{k=1}^{n} S_k (1 + \sin\theta_k - j\cos\theta_k) \qquad (1)$$

where $S_k$ is the $k$-th source signal, $\theta_k$ is the bearing angle between the sound location thereby represented and a laterally central reference location and $j$ is the square root of $-1$.

It will of course be understood that the equality symbol hereinafter refers to proportionality, uniform changes in absolute magnitude in signal-processing being irrelevant.

Figure 5:
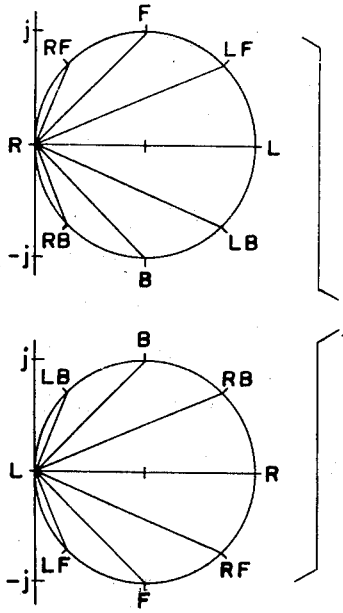
FIG. 5 shows phasor diagrams of transmission signals formed in accordance with the invention.

The phasor coefficients of the respective transmission signals $T_L$ and $T_R$ are shown in FIG. 5 for the particular source positions previously discussed. Signals from (i.e., to appear to be "from" upon reproduction) the left, L, are reproduced in full amplitude and original phase in the $T_L$ signal, but are zero in the $T_R$ signal, and vice versa. The signals from other bearing angles appear in both transmission signals but always in quadrature phase relation, one leading and one lagging the reference phase, which is preserved in the L and R signals. The magnitude of each component is diminished with increase of its relative phase angle (positive or negative), reaching zero at each 90° phase angle (180° difference in source location). The mixing equations below, calculated from the universal matrix above, may be employed for utilizing the invention with fixed four-microphone placements, with or without the addition of other signals such as the "on-mic" touch-up signals frequently added for soloists and other special effects. For the 1-2-1 source orientation, numerical values of the mixing equations are:

$$T_L = S_L + .707\, S_F \angle{+45°} + .707\, S_B\, 110 \angle{-45°}$$

$$T_R = S_R + .707\, S_F \angle{-45°} + .707\, S_B \angle{+45°}$$

For the 2-plus-2 source orientation, numerical values of the mixing equations are:

$$T_L = 0.924\, S_{LF} \angle{+22\tfrac{1}{2}°} + 0.383\, S_{RF} \angle{+67\tfrac{1}{2}°} + 0.383\, S_{RB} \angle{-67\tfrac{1}{2}°} + 0.924\, S_{LB} \angle{-22\tfrac{1}{2}°}$$

$$T_R = 0.383\, S_{LF} \angle{-67\tfrac{1}{2}°} + 0.924\, S_{RF} \angle{-22\tfrac{1}{2}°} + 0.924\, S_{RB} \angle{+22\tfrac{1}{2}°} + 0.383\, S_{LB} \angle{+67\tfrac{1}{2}°}$$

Fixed circuits for producing the desired mixing for one or both of these fixed microphone placements may be constructed if so desired, with or without employment of microphone directional patterns. Additional insertion of signal material may then be made to simulate performance at any location by employment of additional mixers such as shown in the schematic diagram of FIG. 6.

As shown in FIG. 6, the input signal S is fed to a 90° phase splitter 30 which produces a positive and a negative reference-phase signal and a positive and a negative 90° phase-shifted signal. The reference signals and the phase-shifted signals are attenuated (and reversed in polarity where appropriate) in sine and cosine potentiometers 32 and 34 set to the bearing angle at which the signal S is to be simulatively inserted. The positive reference signal and the potentiometer outputs are mixed in summers 36 and 38, the outputs of which are then inserted as components of the signals $T_L$ and $T_R$, respectively, in accordance with the basic encoding equations earlier stated.

In principle, a mixer such as shown in FIG. 6 may be employed for each sound-source direction. However where a substantial number of microphones or soundtracks are desired to be recorded or broadcast in readily selectable angular positions, the number of phase shifters required may be greatly reduced by employing a construction such as shown in FIG. 7. As there shown, each of the signals $S_1$, $S_2$, etc. is fed to a polarity splitter (phase inverter) 40. The positive or in-phase and negative or opposite-phase signal are fed to a sine-cosine potentiometer producing positive and negative signals of amplitude and polarity determined by the angle of potentiometer setting. The unattenuated positive signals and the negative sine signals (which are of course in positive phase for angles having negative sine values) from all sources are mixed in a summer 44. The positive cosine-amplitude signals (negative in phase for angles having negative cosine values) are mixed in a summer 46. The output of the latter is advanced in phase by 90° at 48 with respect to the output of the summer 44 and the two are mixed or summed at 50 to form the signal $T_L$. (As will be recognized by those skilled in the art, the output of the summer 44 must be fed to the summer 50 through a reference-phase portion 52 of the phase shifter 48, the phase-shift of presently available frequency-independent phase-shifters being the difference in phase between the phase-shifted output and the output of a reference-phase channel such as shown at 52, rather than the phase difference between output and input.)

In similar fashion, the positive input signals and the positive sine-function signals from all sources are mixed in a summer 54 and the negative cosine function signals in a summer 56. The latter summed output is advanced in phase by 90° at 58 relative to the reference phase 60 of the output of summer 54, and these are likewise summed at 62 to form the transmission signal $T_R$.

Persons skilled in the art will immediately recognize that the functions performed by certain of the elements shown in FIG. 7 as circuit elements may be carried out by employment of other techniques which are well-known as equivalents for performing such functions in recording and broadcast practice. For example, microphone sensitivity patterns of well-known types may readily be employed in substitution for the indicated attenuation potentiometer networks of some or all of the signals $S_1$, $S_2$, etc., in the signal-mixing system of FIG. 7. Orthogonally positioned dipole microphones may be employed to produce directly the signals attenuated in accordance with the sine and cosine of the azimuthal angle of the incident sound sources, with a closely adjacent single omnidirectional microphone employed to produce the unity or unattenuated components.

As earlier indicated, the transmission signals $T_L$ and $T_R$ may either be recorded on any conventional medium, notably a stereo disc or tape recording, or used for instantaneous reproduction, as in quadrasonic FM broadcasting employing the two audio channels provided for ordinary stereo.

The manner of decoding of the signals of FIG. 5 may now be considered. The decoding closely resembles the encoding, except that the coefficients applied to the transmission signals in the forming of each presentation signal are functions of the angle $\phi$, the listening-space bearing-angle of the loudspeaker for which each presentation signal is formed. Each presentation signal $P_i$ is formed from the transmission signals by mixing in the amplitude and phase relation $$P_i = T_L(1+e^{-j(\phi_i + \pi/2)}) + T_R(1-e^{-j(\phi_i + \pi/2)}) = T_L(1-\sin\phi_i - j\cos\phi_i) + T_R(1+\sin\phi_i + j\cos\phi_i) \quad (2)$$

where $\phi_i$ is the bearing angle between the presentation location and a laterally central reference location and $j$ is the square root of $-1$. Thus each presentation signal is formed by multiplying each transmission signal by the complex conjugate of the multiplier or coefficient used (or which would have been used) in inserting signal from that bearing angle in forming the transmission signal, and the resulting respective products are then added. Each resultant presentation signal $P_i$ is thus:

$$P_i = \sum_{k=1}^{n} S_k(1+e^{-j(\phi_i - \theta_k)}) = \sum_{k=1}^{n} S_k \cos \tfrac{1}{2}(\phi_i - \theta_k)\, e^{-j(\phi_i - \theta_k)/2} \quad (3)$$

The presentation signal $P_L$ for a speaker at the left position is thus the signal $T_L$ as illustrated in FIG. 5, unaltered, and $T_R$ is likewise presented unaltered in forming a presentation signal for a speaker at R (if there is one). Presentation signals for other positions are exactly the same in appearance of phasor diagrams, except that the locations represented are intermediate between the 180° relation shown in FIG. 5 for the L and R signals. Except for a source signal diametrically opposite the presentation point, all source signals appear in every presentation signal, but with a magnitude which varies continuously from maximum to zero as a function of magnitude of the angle between the signal source direction and the presentation direction.

For the 1-2-1 speaker orientation, numerical values of the decoding equation (2) are:

$$P_L = T_L \angle 0°$$

$$P_F = .707\, T_L \angle -45° + .707\, T_R \angle +45°$$

$$P_R = T_R \angle 0°$$

$$P_B = .707\, T_L \angle +45° + .707\, T_R \angle -45°$$

For the 2-plus-2 speaker orientation, numerical values of the decoding equation (2) are:

$$P_{LF} = 0.924\, T_L \angle -22\tfrac{1}{2}° + 0.383\, T_R \angle +67\tfrac{1}{2}°$$

$$P_{RF} = 0.383\, T_L \angle -67\tfrac{1}{2}° + 0.924\, T_R \angle +22\tfrac{1}{2}°$$

$$P_{RB} = 0.383\, T_L \angle +67\tfrac{1}{2}° + 0.924\, T_R \angle -22\tfrac{1}{2}°$$

$$P_{LB} = 0.924\, T_L \angle +22\tfrac{1}{2}° + 0.383\, T_R \angle -67\tfrac{1}{2}°$$

It may be noted that the overall transmission or reproduction is not affected by the choice of transmission signals $T_L$ and $T_R$ to correspond to left and right directions, identical results being obtained with any choice of diametrically opposed directions for transmission in original phase and amplitude in the two respective channels. Association of the transmission signals with the left and right directions, however, provides compatibility with ordinary stereo equipment.

Playback equipment permitting selection of an individual speaker location at any desired angle whatever may be devised along the same lines as the signal-preparation equipment earlier described. However such provision is in general superfluous, since practical speaker placements are not nearly as diverse as microphone placements, in which balance as between front and back, right and left, etc., is optional rather than a requirement. The fixed presentation-signal outputs for the eight positions illustrated suffice to cover the needs and preferences of users of four-speaker systems, while intervals of 15° are wholly adequate for virtually any practical use.

Figure 8:
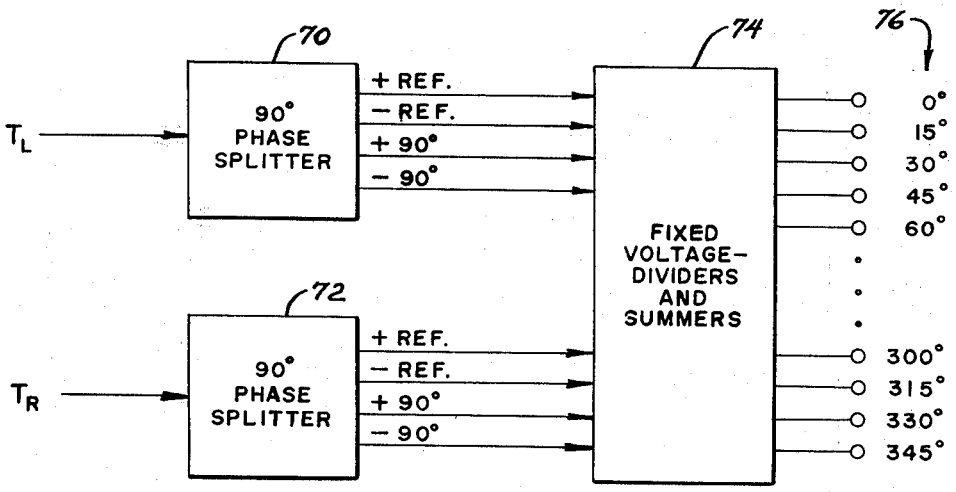
FIG. 8 is a block diagram of one form of decoder incorporating the invention.

There is shown in FIG. 8 one construction for a decoder which may be employed with a very wide variety of speaker geometries. The respective transmission signals $T_L$ and $T_R$ are fed to 90° phase shifters 70 and 72, each of which has positive and negative reference-phase and phase-shifted outputs. These outputs are fed to a fixed mixing network 74 consisting of voltage-dividers attenuating the input signals and distributing the signals so attenuated to summers producing outputs in accordance with equation (2). Fixed output terminals 76 are provided for presentation through suitable amplifiers by loudspeakers at any selected multiple of 15° intervals (or any other intervals for which outputs are provided). The number and placement of speakers may thus be selected in accordance with the preference (including economic limitations) of the user. In general, the speakers are normally preferred to be equally spaced in bearing-angle and equidistant from the listening position, i.e., disposed in the form of a square or regular polygon. However room shape and acoustics and personal preferences may result in other arrangements in many cases.

Another form of decoder with selectable fixed-location output terminals is shown in FIG. 9. The transmission signals $T_L$ and $T_R$ are fed to a sum and difference circuit 80 to produce a sum signal $T_\Sigma$ and a difference signal $T_\Delta$. The difference signal is treated in the same manner as at 70 or 72 of FIG. 8, the separate phase-shifter channels for the reference phase 82 and the shifted phase 84 being again shown in FIG. 9. The respective polarities of the reference and phase-shifted difference signal $T_\Delta$ are fed to fixed voltage dividers at 80 and 88 and the attenuated outputs are fed to summers 90 along with the sum signal $T_\Sigma$ from the reference-phase channel 91 producing output presentation signals for the pre-selected angles $\phi_1$, $\phi_2$, etc., for which the taps on the attenuators or dividers 86 and 88 are designed.

Where the invention is employed in standard stereo FM broadcasting, the function of the sum and difference circuit shown in FIG. 9 at 80 is performed in the standard stereo matrixing, and the circuit 80 may be omitted in decoding. It will be observed that such sum and difference signals $T_\Sigma$ and $T_\Delta$ may be directly formed from source signals and employed as transmission signals without formation of signals $T_L$ and $T_R$, being formed substantially as follows:

$$T_\Sigma = \sum_{k=1}^{n} S_k$$

$$T_\Delta = \sum_{k=1}^{n} S_k(j \cos \theta_k - \sin \theta_k) = \sum_{k=1}^{n} S_k e^{j(\theta_k + \pi/2)} \qquad (4)$$

The transmission signal pair $T_L$ and $T_R$ contains exactly the same information as the transmission signal pair $T_\Sigma$ and $T_\Delta$, and these signal sets are readily convertible from one form to the other in either direction without any alteration of the available information content. Although these two forms of the same signal information are normally the most useful and simplest in equipment implementation, other transmission signal pairs identical in overall information content and ready convertibility to and from these specific forms may be devised and will be understood to be included in the expressions above.

If so desired, individual presentation signals may, after formation, be "touched up" in accordance with listener preference. For example a particular listener may find the overall effect more pleasing with further phase shifting of one or more of the presentation signals after the formation thereof (not shown). As another example, directional effects may be emphasized by auxiliary signal treatment of the same type heretofore employed with other coding and decoding systems, such as varying the amplification of amplifiers feeding particular loud-speakers to increase apparent "contrast" or sound-source localization for certain types of sounds.

It will be observed that the encoded transmission signals are readily useable with existing reproduction equipment having no provision for decoding of multidirectional signals. The sum of the two transmission signals is the simple sum of all of the source signals in their original phase. Thus employment of the transmission signals in the sum-and-difference mono-compatible matrixing of stereo FM broadcasting, or reproduction of an encoded stereo disc recording on a monaural phonograph, produces perfect monaural reproduction. The employment of the two encoded channels as the left and right channels of conventional stereo reproduction produces only slightly less apparent left-right separation than a conventional stereo recording (as in prior systems for quadrasonic encoding and decoding with two-channel transmission).

If so desired, provision may be made in the decoder for artificially encoding ordinary stereo signals containing no directional information, so that such program material is reproduced in the multidirectional speaker system in a manner generally resembling the reproduction of signals wherein the further directional information is encoded. Ordinary stereo signals correspond to source signals at left front, LF, and right front, RF. There is shown in FIG. 10 an adapter which may be substituted for the sum and difference circuit 80 of FIG. 9, for example by a switch on the decoder, to produce a listener effect or sensation similar to that of direction-encoded signals having source-signal components only from these directions. The ordinary stereo signals are fed to respective 45° phase splitters 92 and 94 to produce a sum signal $T_\Sigma$ in reference phase and a difference signal $T_\Delta$ in quadrature phase.

It has previously been mentioned that the selection of the two transmission signals for direct reproduction at L and R locations, respectively, is of significance only for compatibility with conventional stereo equipment having no decoding provision. In its broader aspects, the invention may be employed in applications wherein stereo compatibility is unimportant. For example, the invention may be used for the sole purpose of conserving tape space, and thus extending playing time, in the general type of recording now done in four or more discrete tape channels. By compressing the information into two recording channels and then expanding in playback, much greater utilization of tape space is made. In such use of the invention the reference direction of the bearing-angles used in encoding may be chosen more or less arbitrarily, and the directions represented by the two transmission signals are accordingly equally arbitrary, so long as they are selected in diametric opposition.

The particularized embodiments of the invention thus far described are confined to those designated for use with the two-channel transmission systems which are currently standard for stereo broadcasting and disc recording. However the broader aspects of the invention are of wider application. The two-channel transmission thus far described is merely a specific application of principles which may be advantageously employed for reproducing directional audio information with larger numbers of channels than two. By employment of the invention, the results obtainable with transmission limited to the two channels used in conventional stereo reproduction are optimized. However, in further accordance with the invention, a larger number of channels may advantageously be employed. A primary use for a larger number of channels is to sharpen the directionality pattern for any given speaker array, i.e., to reduce the cross-talk which is an unavoidable consequence of employment of a number of loudspeakers larger than the number of transmission channels. But the invention in these further aspects has great advantage even where the number of transmission channels is equal to or greater than the number of required presentation signals, not only for the purpose of permitting "rotation" of presentation signals, such as in reproduction of a four-track tape recording recorded for 2-plus-2 loudspeaker presentation on loudspeakers arranged in a 1-2-1 orientation, but for other purposes later seen.

Understanding of the application of the invention to numbers of channels greater than two will be facilitated by first considering certain aspects of the performance and underlying theory of the two-channel system already described. It may be seen upon study that the essence of the advantageous novelty stems from the fact that the sum of all products of the function of $\theta$ applied to the source signals at bearing angles $\theta$ in formation of each transmission signal and the function of $\phi$ applied to that transmission signal in the formation of each presentation signal at bearing angle $\phi$ is a single-variable function of the difference between the angles $\theta$ and $\phi$ having a maximum absolute value at a reference difference angle, a relatively small absolute value at the diametrically opposite difference angle, and absolute values at intermediate angles symmetrical with respect to the axis thus defined. It is this characteristic which imparts the rotatability or universality of the loudspeaker patterns for which the transmission signals may be decoded.

It will be obvious that all functions which satisfy these criteria are not of wholly equal merit as regards simulation of discrete-channel direct reproduction in psychoacoustic effect. All other factors being equal, it is desirable that the amplitude or absolute value of the overall reproduction function have a zero or null at 180° from the maximum. Likewise, all other factors being equal, it is desirable that the amplitude pattern decrease as rapidly as possible from its maximum value, which occurs where $\theta$ equals $\phi$, e.g., where the difference angle $\alpha$ is zero. Further, again with all other factors being equal, it is desirable that phase differences between the appearances of any given source sound in the various presentation signals be minimized, i.e., that the overall reproduction have a minimum of relative phase difference.

The relative importance of these three factors in producing the illusion of presence at the actual performance is a psychoacoustic matter which is presently incapable of quantitative evaluation. It has been experimentally established that the reproduction produced by the two-channel matrixing of the above-described embodiments is more satisfactory than with other matrices for the same purpose. The performance may be described in terms of the factors of merit above by the following: The pattern demonstrates a complete null at 180°, an amplitude reduction of −3 dB at 90°(and of course 270°, these being a convenient point of reference for measuring pattern "sharpness"), and no component is presented with a phase difference of as great as 180° from any other, any components which are reproduced with a difference of phase approaching 90° from their original relative phase being essentially negligible in amplitude. The employment of overall functions which are better in one respect, but at the sacrifice of another, is accordingly within the broad purview of the invention, although it can be shown from information theory and sampling theory that the reproduction information given by mixing and re-mixing coefficients determined as above is as accurate as is possible with only two transmission channels.

The characteristics or performance factors just described can be substantially further improved by applying the same general principles in the construction of transmission signals for three or more transmission channels. Such applications of the principles of the invention may be roughly divided into two categories in their relation to the two-channel embodiment already described: (1) systems employing one or more auxiliary channels or transmission signals in addition to the two transmission signals already described and (2) systems which employ three or more transmission signals which display the same type of mutual symmetry as the $T_L$ and $T_R$ signals of the two-channel system.

Three-channel (and further multiple-channel) systems of the first type mentioned above may be described as "compatible" with the two-channel system. One current utility of such embodiments of the invention is in the production of three-track or four-track tape recordings which may be played back, with suitable decoding, with any desired multiple array of speakers or may, alternatively, be played back as ordinary stereo recordings by equipment which cannot utilize the auxiliary recorded channel or channels. Even greater utility, however, lies in the substantial advantages which the invention possesses in making it practical to incorporate quadrasonic signals which are effectively wholly discrete in reproduction in media such as FM broadcasting and disc recording.

The encoding and decoding of each auxiliary channel is of course such as to maintain the above-described essential characteristics of the overall transmission or presentation function. In principle, it may be possible to devise added-channel transmissions which may be decoded along with the two primary or basic transmission signals by devising complex decoding for all channels which departs completely from the two-channel decoding in producing a desirable overall playback function in which the difference angle $\alpha$ is the sole variable. However it is more desirable to preserve the same manner of decoding of the two basic channels and merely add to each presentation signal the auxiliary information contained in the coded and decoded auxiliary transmission signals. In order to do this, it is necessary that the encoding and decoding of each of the auxiliary transmission signals produce an added component for the presentation signal which is itself a function solely of the difference angle having a maximum value at zero difference angle. The simplest and most desirable manner of utilizing additional channels is to employ an encoding function of $\theta$ for production of each auxiliary transmission signal which, when multiplied by the conjugate decoding function of $\phi$, itself produces a product which is a single-variable function of the difference angle and which, when added to the presentation signal function which results from the two-channel transmission, increases the sharpness of the amplitude maximum in the pattern. These requirements for the auxiliary channel are met by the employment of an appropriate exponential function of $\theta$ in encoding and its conjugate function of $\phi$ in decoding. The addition of a third transmission signal $T_T$ using a mixing coefficient proportional to $e^{-j(\theta + \pi/2)}$ for each signal $S_\theta$ and a remixing coefficient proportional to $e^{j(\phi + \pi/2)}$ in forming the added component for each presentation signal $P_\phi$ produces a product function of the difference in angles which, when added to the basic two-channel presentation function, substantially sharpens the directional effects. The overall presentation signal is $$P_i = \sum_{k=1}^{n} S_k [1 + 2 \cos (\phi_i - \theta_k)] \qquad (5)$$

With this overall playback function, all sound sources are produced in all speakers in their original relative phase, and the amplitude for an angle difference of 90° (or, of course, 270°) is about 10 dB less than the maximum at 0°.

The auxiliary signal $T_T$ thus formed may be employed with either the $T_L$ and $T_R$ transmission signals of equations (1) or the transmission signals $T_\Sigma$ and $T_\Delta$ of (4) above. The overall playback function thus obtained, although improving the pattern in the respects just mentioned, produces a signal component at 180° of the same magnitude as the signal component at 90°, i.e., about −10 dB from the maximum at 0°. This "backlobe" may be eliminated by a simple alteration. Considering the $T_\Sigma$ and $T_\Delta$ form of transmission, if the $T_\Delta$ and the $T_T$ signals are attenuated by the square root of one-half, but without change in $T_\Sigma$, and decoding by conjugate functions of $\phi$ is carried out, the resultant overall transmission function is $$P_i = \sum_{k=1}^{n} S_k [\cos \tfrac{1}{2} (\phi_i - \theta_k)]^2$$

This overall reproduction function produces presentation signals free of phase shifts and with a null at 180°, the magnitude at 90° being down 6 dB from the maximum at 0°. The same result is of course obtained with appropriate partial blending of the $T_L$ and $T_R$ signals previously described, and the same attenuation of $T_T$. Where the basic pair of transmission signals is thus modified, the performance on equipment not capable of utilizing the third channel is obviously impaired. Accordingly, the recorded or broadcast sets of transmission signals will not normally include this alteration. The modified set of transmission signals is preferably generated in the decoder from the unmodified signals as recorded or broadcast.

The overall transmission or presentation equation set forth above resulting from the modified transmission signals has a coefficient expression shown in brackets which may also be written as $$1 + \cos (\phi_i - \theta_k)$$

This will be seen to be of the same form as the equation (5) coefficient for the unmodified three transmission signals, each overall presentation signal being expressable as $$P_i = \sum_{k=1}^{n} S_k [1 + 2m \cos (\phi_i - \theta_k)] \qquad (6)$$

where $m$ is the square of the attenuation factor used in forming the modified $T_\Delta$ and $T_T$. Appreciable variation in details of reproduction characteristics is obtained by selection of $m$. As $m$ is varied in the range from 0.5 to 1.0, the "backlobe" earlier mentioned is re-introduced, but the "90° separation" is simultaneously improved as indicated numerically earlier. With $m$ having an intermediate value of 0.707, the 90° separation is 7.66 dB and the backlobe level is 28.3 dB below the 0° maximum. The choice of the constant $m$ thus involves a tradeoff of desirable pattern characteristics which is incapable of evaluation as regards psychoacoustic effectiveness to the listener, and the three-channel decoder is desirably provided with means for adjustment by the user of the factor $m$ above defined within the range of 0.5 to 1.0. It will be observed that where the factor $\sqrt{m}$ is introduced into the transmission signals at the decoder, and the conjugate functions thereupon immediately applied for decoding, the latter also of course including the factor $\sqrt{m}$, the two successive attenuations by the factor $\sqrt{m}$ may be replaced by a single attenuation by the factor $m$, as by ganged attenuator potentiometers at the inputs for the unmodified $T_\Delta$ and $T_T$ signals, whereby the user may select a value of $m$ between 0.5 and 1.0.

The same general principle may be employed in further adding a fourth channel for still further increasing the "contrast" between the amplitude of reproduction of a source signal from a loudspeaker in a position corresponding to the original position of the source and the amplitude of its reproduction from other loudspeakers, i.e., in further sharpening of the overall presentation signal functions of (5). A fourth channel addition to the three channels described above which meets the criteria already described is the transmission signal $T_Q$ formed as follows (with the exponent positive or negative):

$$T_Q = \sum_{k=1}^{n} S_k e^{2j(\theta_k + \pi/2)}$$

Such a function may be produced by summing the outputs of two quadrupole microphones (each with one dipole pattern opposed in phase to the other dipole pattern) relatively rotated by 45°, with the output of one quadrupole shifted in phase by 90°. Alternatively (or as a supplement; mixing circuits obtained by appropriate modification of those previously described may be employed. An attenuation factor equal to the square root of a constant $m$ may be applied to the transmission signals $T_T$ and $T_Q$ in the formation and conjugate-function decoding of these auxiliary transmission signals. The overall presentation signals are in this case of the form:

$$P_i = \sum_{k=1}^{n} S_k (1 + e^{-j(\phi_i - \theta_k)} + me^{j(\phi_i - \theta_k)} + me^{-2j(\phi_i - \theta_k)}) \qquad (7)$$
$$= \sum_{k=1}^{n} S_k e^{j(\phi_i - \theta_k)/2}[\cos \frac{1}{2}(\phi_i - \theta_k) + m \cos \frac{3}{2}(\phi_i - \theta_k)]$$

The phase relations of the source-signal components in each presentation signal are the same as in the two-channel case, except in a relatively minor respect to be later mentioned. However, the 90° separation is vastly improved, as now seen.

The effects of variation of $m$ with the fourth channel added are in broad terms generally similar to those of the corresponding variation in the three-channel case already discussed. For a value of $m$ of 0.333, the pattern is of the cardioid type but the 90° separation from the maximum at 0° is 9 dB. For a value of $m$ of 0.5, the null at 180° is preserved but very small backlobes (−23.9dB) appear in the adjacent regions; the 90° separation is 12.6 dB. With a value of $m$ of 1.0, nulls appear at both 90° displacements and at 180°, but there are noticeable magnitudes (−11.3 dB) at about 130° in each direction from the 0° maximum. Unlike the three-channel case, the manner of inserting the factor $m$ does not affect the two basic transmission channels, so that it may be inserted either in the encoding equipment, the decoding equipment, or a combination of both. The factors involved in selection of $m$ by the listener are generally similar to those in the three-channel case, and the listener may be provided with adjustment of this factor in the range from 0.33 to 1.0 if so desired. For this $T_T$ and $T_Q$ are transmitted without the $m$-factor attenuation, attenuated just prior to the decoding, and thereupon decoded by employing the conjugate-function rematrixing already described. However an even more advantageous utilization of the effects produced by variation of the factor $m$ in (7) above may be made in connection with reducing the frequency-range requirement of the two auxiliary channels, without impairment of the reproduction.

There is shown in FIG. 11 an overall system of encoding, transmission, and decoding employing the four-channel matrixing of the invention, with input signal sources designated $S_{\theta\ 1}$, $S_{\theta\ 2}$, etc. and output or presentation signals designated $P_{\phi\ 1}$, $P_{\phi\ 2}$, etc., each input signal and each output signal being identified with an azimuthal direction. (The azimuthal angles are in this instance measured counterclockwise from a reference direction at the right of the listener, thus including the $\pi/2$ angle additive appearing in the forms of expression heretofore used herein for simplicity of demonstration of the actual right-left symmetry inherently possessed by the matrix.) In formation of the $T_\Sigma$ transmission channel signal, all of the signal sources are merely additively mixed without phase alteration. To form the $T_\Delta$ transmission channel signal, each source signal is phase-shifted to produce, for each of its frequency components, a phase lag with respect to the corresponding $T_\Sigma$ component equal to the source azimuthal angle (whether actual or synthetic) and with unaltered amplitude. The $T_T$ auxiliary channel is formed identically with the $T_\Delta$ channel, except that the direction of phase-shift is reversed. The $T_Q$ channel is formed in the same manner as the $T_\Delta$ or $T_T$ except that each phase shift angle is doubled. Prior to transmission, the $T_Q$ and $T_T$ signals are band-pass filtered to limit their content by limitation to mid-range frequencies, such as from 130 Hz to 3kHz. Because the band-pass filtering of the auxiliary channels inherently produces further phase shifts in the passed band, phase equalizers are employed for the $T_\Delta$ and $T_\Sigma$ channels to maintain the desired phase relations in the signals as transmitted. (The term "transmitted" as used throughout will of course be understood to include the various forms of recording or signal-storage employed for later reproduction, such as phonograph records and tapes, as well as the instantaneous transmission employed in such media as FM broadcasting.)

It will be observed that the basic signal pairs $T_R$ and $T_L$ or $T_\Sigma$ and $T_\Delta$ incorporate each sound-source signal in a reference phase and an azimuth-identifying phase differing from the reference phase by a phase-angle equal to the azimuthal angle of the sound source. This is most obvious in the case of $T_\Sigma$ and $T_\Delta$, where one channel carries only the reference-phase component and the other carries only the azimuth-identifying component. The other form of the transmission pair carries exactly the same signal information, however, although linear operations are required to separate these distinct signal components. The third channel $T_T$ incorporates each signal in a relative phase equal but opposite to the azimuth-identifying phase and the fourth signal $T_Q$ is formed in the same manner as $T_\Delta$ or $T_T$ except that the phase differs from the reference phase by a doubled phase-angle for the corresponding signal source.

The generalized showing of FIG. 11 is of course applicable to radio broadcasting, recording, or any other audio reproduction medium. It is of particular advantage where required transmission bandwidth is a problem, since the limited frequency range of the auxiliary channels permits reduced bandwidth requirement as compared with quadrasonic systems wherein the same four transmission channels are each used for the presentation signal at a location assigned to that channel. The utility of the four encoded channels in various recording and FM transmission schemes which have heretofore been proposed for the latter type of transmission is obvious, and it will be understood that the showing in the drawing of direct feeding of the transmission channels to the decoding portion is highly schematic, the direct connections shown normally representing production and reproduction of a recording or FM broadcast employing multiplex provision for the auxiliary channels. (As will be evident, the channels $T_\Sigma$ and $T_\Delta$ of FIG. 11 will normally be replaced by $T_L$ and $T_R$ in recording equipment for which this form is more appropriate.)

In a preferred utilization of the system of FIG. 11 in FM broadcasting the two basic channels are transmitted as the sum and difference signals of conventional mono-compatible stereo broadcasting. The auxiliary signals are alternated at a sampling frequency of 9.5 kHz and multiplexed together as a composite modulation of the quadrature-phased 38-kHz carrier known in the art for speaker-identified quadraplex FM transmission, but heretofore objectionable because of bandwidth requirement. In another preferred embodiment, the four channels (using $T_L$ and $T_R$ as the basic stereo channels) are substituted for speaker-identified channels in the four-channel disc reproducing system described at Volume 19, page 576, of the *Journal of the Audio Engineering Society*.

The processing of each of the four transmission channels in the decoding equipment (associated with an FM receiver, for example) prior to addition to form each presentation signal is conjugate to the treatment by which that transmission channel was produced, except that the angles of phase-shift correspond to the locations of the loudspeakers, rather than the sound sources. The $T_\Sigma$ signal is again unaltered in phase and continues to serve as a reference phase, its suitability for this purpose again being maintained by reference phase shifts required by the operation of the frequency-independent phase shifters employed for the other channels. For a sound-source at the same azimuth as the presentation speaker, the altered outputs of the four transmission channels are all in phase and directly additive.

As the final step of production of the presentation signal, each presentation signal is passed through an amplitude equalizer or band-attenuating filter which is generally complementary to the band pass filters used in the auxiliary channel signal formation except for the attenuation magnitude. In the frequency region wholly unaffected by the band-pass filters, each equalizer attenuates the signal by 3 dB, and compensation for the power contribution of the auxiliary channels is similarly made in the adjoining upper and lower roll-off portions of the pass band of the filters used in transmission. Sharpness of the band-pass filter characteristics and corresponding equalization filter characteristics is not required, for reasons later to be mentioned.

Numerical values of the encoding matrix, the decoding matrix, and the overall playback matrix (for frequencies of the fully-transmitted mid-range) are shown in FIG. 12 for the conditions corresponding to those heretofore used in conventional four-track reproduction, which identifies each transmission channel with a specific loudspeaker of the 2 plus 2 speaker array. For convenience of understanding of aspects related to compatibility with existing monaural and stereo reproducing equipment, as well as illustrating the relation between the basic two channels, and the auxiliary channels, of the invention, the encoding and decoding matrices are shown with the matrix elements separated in this respect. Likewise, for clarity of understanding, the overall playback matrix is shown in an unsimplified form from which most of the terms vanish upon expansion, as will be seen upon study. As shown by the vanishing of all other coefficients in the overall playback matrix, the signal frequencies which are unattenuated in $T_T$ and $T_Q$ appear only in a single loudspeaker because the other three speakers are in each case at the nulls previously mentioned. Since all presentation signals of this type are of the reference phase, the reproduction of these frequencies is exactly the same as in the case of direct transmission of each loudspeaker signal from the corresponding sound source.

The matrix coefficients of FIG. 12 are of course not directly applicable either to signals of frequencies which are attenuated in the $T_T$ and $T_Q$ channels or to signals encoded for azimuthal directions other than the four equally-spaced speaker locations shown. As regards the former, frequencies wholly outside the filter pass-band (and the corresponding equalization attenuation band) are transmitted and reproduced only in the basic two-channel system. FIG. 13 shows, in polar diagram form, the amplitudes and phase angles of reproduction for the four-channel and two-channel systems as a function of the angle between each speaker location and the sound-source location portrayed. In addition, the Figure shows, in dotted form, the amplitude of reproduction of a typical "transitional" frequency component, i.e., a frequency component in the partial-attenuation (and subsequent relative boost) or roll-off region, corresponding to one intermediate or fractional value of m. Sharp definition of the band of frequencies transmitted in $T_\Sigma$ and $T_\Delta$ (or $T_L$ and $T_R$ where this form is used) is accordingly not required, and simple forms of filters may be employed without necessity for sharp cutoff limits.

It will be noted from FIG. 13 that the small "back-lobes" of the full four-channel pattern are of opposite phase from the corresponding portion of the two-channel pattern, although the phases of both patterns are the same in regions of less than 90° difference between sound-source azimuth and speaker azimuth. However the earlier mentioned limitation to a maximum of 90° of phase difference in diametrically opposed speakers is seen to be maintained, and no objectionable psychoacoustic effects result.

Listening tests show that program-material reproduction available with the bandwidth-limited channels of this aspect of the invention is at least as acceptable psychoacoustically as that of a conventional full-bandwidth discrete four-channel system. No substantial loss of directional information is produced by the frequency limitation in the auxiliary channels, since psychoacoustic sensing of azimuthal direction does not in any event rely on the very low frequencies or on frequencies of wavelength small compared to human head dimensions. For sound-sources emanating (or portrayed to emanate) from between-speaker locations, ability of critical listeners to identify the direction accurately is found to be substantially enhanced as compared with conventional four-channel reproduction, which normally presents such signals in the same phase, weighted in amplitude, in two adjacent speakers, to simulate such a sound. At least to many listeners, the phase and amplitude contribution of other speakers in the presentation appears psychoacoustically useful in permitting more precise identification of location of synthesized between-speaker sound images than is possible with the mere adjacent-speaker amplitude-ratios used in conventional four-channel quadrasonic practice. Accordingly, it is within the contemplation of the invention that a system such as that of FIG. 11 may be used in production of four-track tape-recordings or the like (for which use, of course, the bandwidth-limiting and compensating equalization features would be omitted).

As will be evident, the principles of the invention may be further extended to still higher numbers of channels while preserving the two basic transmission signals $T_L$ and $T_R$ or $T_\Sigma$ and $T_\Delta$ for reproduction on equipment not capable of using the auxiliary channels.

In addition to such addition of auxiliary channels for the two-channel system first described herein, which may be considered as "compatible" additions to the basic two-channel system, the principles of the invention may be employed for multiple channels which are all associated with particular bearing angles in the same general manner as the signals $T_L$ and $T_R$ are identified with the directions left and right, i.e., the signals may be played back directly or decoded for other speaker positions.

Understanding of this aspect of the invention will be promoted by first considering further theory of the basic two-channel embodiment earlier described. In the discussion up to this point, bearing angles $\theta$ and $\phi$ for all channels have been considered as measured from the same reference azimuth. As already described this produces slightly different encoding functions for the left and right transmission signals $T_L$ and $T_R$, which are unaltered in producing presentation signals for speakers at these opposed side locations. If there be considered an angle $\theta'$ for each sound source, measured from the left direction or bearing angle for $T_L$ and from the right direction or bearing angle for $T_R$, the encoding function or mixing coefficient function for both of these transmission signals may be expressed as:

$$1 + \cos\theta' + j\sin\theta' = 1 + e^{j\theta'}$$

For reasons shortly apparent, this may advantageously be now rewritten in the form $$\tfrac{1}{2} + \tfrac{1}{2}\cos\theta' + \tfrac{1}{2}j\sin\theta'$$

(It may have already been observed that this fractional representation has merely been disregarded for simplicity heretofore in instances where its presence would be required for rigorousness, for example in dropping a multiple 2 in deriving equation (3) from equations (1) and (2)).

The above expression for the forming of each transmission signal from source signals, using the direction to which the transmission signal corresponds as the reference for the bearing angle of the source, may be designated $f_2(\theta')$, where the subscript indicates the encoding function for each of two channels.

In similar fashion, the decoding function $f_2(\phi')$ for each transmission channel in forming each presentation signal may be stated as $$\tfrac{1}{2} + \tfrac{1}{2}\cos\phi' - j\sin\phi'$$

where $\phi'$ is the bearing angle of the presentation signal with reference to the direction to which the transmission signal corresponds. The overall or summed presentation signal function is of course not affected by this alteration of reference point used in the encoding and decoding, being the same as the encoding function except for the difference-angle argument $\alpha$.

Similar encoding functions (and conjugate decoding functions) may be employed for larger numbers of transmission signals corresponding to equally-spaced directional angles. For three channels, at 120° intervals, the encoding function is $$f_3(\theta') = \tfrac{1}{3} + \tfrac{2}{3}\cos\theta'$$

and the decoding function of $\phi'$ is identical (the function having no imaginary term). The overall presentation signal function is again identical with the encoding function except for the difference-angle argument. It will be seen that this overall function is exactly the same as that obtained with the unmodified "compatible" three-channel system set forth above at (5). It may be demonstrated that the compatible and "equal-spaced" transmission signals are each linear combinations of the other, i.e., derivable from each other by reversible methods of linear combination which produce no change in the information content.

For four channels or transmission signals (primary transmission signals at each 90°) the encoding function for each is

$$f_4(\theta') = \tfrac{1}{4} + \tfrac{1}{2}\cos\phi' + \tfrac{1}{4}\cos 2\theta' + \tfrac{1}{4}j\sin 2\theta'$$

and again the overall reproduction is the same as with the compatible four channel system (unmodified) earlier discussed which is related by linear transformation. Accordingly, it will be understood, where applicable, that references herein or in the appended claims to any particular matrixing equations include linear-transformation variants thereof.

Such encoding may of course be used in the making of discrete-signal four-track recordings which can be played back with any desired speaker array, or the presentation signals may be recorded for the improved image-localization of ordinary discrete-channel playback equipment discussed above in connection with FIG. 11, or for other purposes which do not require the monaural and stereo compatibility of the forms of the invention earlier described.

It may be shown that further extension of this specific method of encoding and decoding in accordance with the invention may be made to any number n of channels representing equally-spaced bearing angles by the expression, for any odd number of channels, $$f_n(\theta') = \frac{2}{n}\left(\tfrac{1}{2} + \cos\theta' + \cos 2\theta' + \ldots + \cos\frac{n-1}{2}\theta'\right)$$

and by the expression, for any even number of channels, $$f_n(\theta') = \frac{2}{n}\left(\tfrac{1}{2} + \cos\theta' + \cos 2\theta' + \ldots + \cos\frac{n-2}{2}\theta'\right) + \frac{1}{n}\left(\cos\frac{n}{2}\theta' + j\sin\frac{n}{2}\theta'\right)$$

As will be apparent, the larger the number of channels available, the larger the variety of particular encoding and conjugate decoding functions which may be devised for practicing the basic aspects of the invention, and the embodiments described above are merely illustrative of the simplest, particularly with numbers of transmission channels greater than 2. More complex functions, employing numerical factors in coefficients of various components more or less analogous to the single factor m earlier discussed, may be devised, as well as the forms of linear combinations.

Persons skilled in the art will accordingly readily devise many further variants of the specific embodiments of the invention herein selected for illustration and description. For example, interchange of $j$ and $-j$ in any coding and decoding operations is an exemplary obvious equivalent and others less obvious will be devised. The protection to be afforded the invention should thus extend to all utilizations thereof as defined in the appended claims, and equivalents thereto.

What is claimed is:

1. In the method of audio reproduction wherein multidirectional source signals are transmitted in two channels adapted for monaural and stereo loudspeaker presentation and having the multidirectional signals encoded in said two channels with predetermined amplitude and phase relations indicative of source directions and adapted to be decoded for formation from the signals in said two channels of more than two loudspeaker presentation signals having source signals corresponding to every source direction appearing in a plurality of such presentation signals but in differing relative amplitude, the improvement comprising transmitting said multidirectional source signals encoded in at least one auxiliary channel with predetermined amplitude and phase relations differently indicative of source directions relative to the amplitude and phase relations of the multidirectional signals encoded in said two monaural and stereo compatible channels, decoding the signals of all of said transmission channels to form multidirectional presentation signals wherein said decoding of all of said transmission channels is carried out by decoding said two monaural and stereo compatible channels to provide a first set of more than two loudspeaker presentation signals for presentation at more than two listening space bearing angles and having source signals corresponding to every source direction appearing in a plurality of such presentation signals but in different relative amplitude and decoding said auxiliary channel or channels to provide a second set of a plurality of presentation signals for presentation at listening space bearing angles corresponding to the listening space bearing angle presentation directions of said first set of presentation signals, and adding to each of said first set of presentation signals the signal of said second set of presentation signals for the corresponding listening space bearing angle to provide a plurality of output signals for the presentation directions corresponding to the presentation directions of said first set of presentation signals but with a sharpened directionality pattern with respect to that of said first set of presentation signals.

2. A method in accordance with claim 1 wherein there are four audio input signals representing an orthagonal directional array and wherein each of said two monaural and stereo compatible channels hncludes at least three of said four audio input signals.

3. A method in accordance with claim 2 wheqehn said source directions are front, back, right and left, and wherein said predetermined amplitude and phase relations of said source signals in said two monaural and stereo compatible channels, designated $T_L$ and $T_R$ for left and right transmission channel, respectively, are $$T_L = S_L + 0.707\ S_F\ \angle{+45^\circ} + 0.707\ S_B\ \angle{-45^\circ}$$

$$T_R = S_R + 0.707\ S_F\ \angle{-45^\circ} + 0.707\ S_B\ \angle{+45^\circ}$$

where $S_F$ is the source signal from the front direction, $S_R$ is the source signal from the right direction, $S_B$ is the source signal from the back direction and $S_L$ is the source signal from the left direction.

4. A method in accordance with claim 2 wherein said source directions are left front, left back, right front and right back and wherein said predetermined amplitude and phase relations of said source signals in said two monaural and stereo compatible channels, designated $T_L$ and $T_R$ for left and right transmission channel, respectively, are $$T_L = 0.924\ S_{LF}\ \angle{+22\tfrac{1}{2}^\circ} + 0.383\ S_{RF}\ \angle{+67\tfrac{1}{2}^\circ} + 0.383\ S_{RB}\ \angle{-67\tfrac{1}{2}^\circ} + 0.924\ S_{LB}\ \angle{-22\tfrac{1}{2}^\circ}$$

$$T_R = 0.383\ S_{LF}\ \angle{-67\tfrac{1}{2}^\circ} + 0.924\ S_{RF}\ \angle{-22\tfrac{1}{2}^\circ} + 0.924\ S_{RB}\ \angle{+22\tfrac{1}{2}^\circ} + 0.383\ S_{LB}\ \angle{+67\tfrac{1}{2}^\circ}$$

where $S_{LF}$ is the source signal from the left front direction, $S_{LB}$ is the source signal from the left back direction, $S_{RF}$ is the source signal from the right front direction and $S_{RB}$ is the source signal from the right back direction.

5. A method in accordance with claim 1 wherein there are two of said auxiliary channels.

6. A method of audio reproduction of multidirectional source signals comprising the steps of transmitting the source signals encoded in two basic transmission channels and also transmitting a limited frequency range of the source signals in at least one auxiliary transmission channel having a frequency range substantially narrower than the first two channels and corresponding to said limited source signal range, phase compensating the signals in said first two transmission channels to match any frequency-dependent phase characteristics attributable to the narrowing of the frequency range in said auxiliary channel or channels, matrixing the signals from all said channels to form more than two directional presentation signals, and individually attenuating the narrower frequency range of each of the presentation signals to essentially the same extent to restore the frequency components of said source signals to their original relative amplitude.

7. A method in accordance with claim 6 for FM broadcasting wherein said two basic channels are transmitted as sum and difference signals adapted for monaural compatible stereo broadcasting, and wherein there are two of said auxiliary channels which are alternated at a sampling frequency of 9.5 $KH_z$ and multiplexed together as a composite modulation of a quadrature-phased 38-$KH_z$ carrier signal.

* * * * *

UNITED STATES PATENT OFFICE

CERTIFICATE OF CORRECTION

Patent No. 3,970,788 Dated July 20, 1976

Inventor(s) Duane H. Cooper

It is certified that error appears in the above-identified patent and that said Letters Patent are hereby corrected as shown below:

The term of this patent subsequent to September 16, 1992, has been disclaimed.

Signed and Sealed this

Twenty-eighth Day of September 1976

[SEAL]

*Attest:*

RUTH C. MASON
*Attesting Officer*

C. MARSHALL DANN
*Commissioner of Patents and Trademarks*